United States Patent [19]

Langer et al.

[11] Patent Number: 4,669,597

[45] Date of Patent: Jun. 2, 1987

[54] ESCALATOR SKIRT PANEL

[75] Inventors: Hans-Jurgen Langer, Hespe; Peter Lehmann, Stadthagen, both of Fed. Rep. of Germany

[73] Assignee: Otis Elevator Company, Farmington, Conn.

[21] Appl. No.: 794,811

[22] Filed: Nov. 4, 1985

[51] Int. Cl.[4] ..... B66B 25/00

[52] U.S. Cl. ..... 198/323

[58] Field of Search ..... 198/323

[56] References Cited

FOREIGN PATENT DOCUMENTS

| | | | |
|---|---|---|---|
| 122591 | 9/1979 | Japan | 198/323 |
| 159988 | 12/1979 | Japan | 198/323 |
| 374169 | 2/1964 | Switzerland | 198/323 |

OTHER PUBLICATIONS

Bircher Ag, information sheets 400, 401, Apr. 1978.

*Primary Examiner*—Joseph S. Valenza

[57] ABSTRACT

Increased safety in the area of running clearance between the step (12) and the skirt panel (10) of an escalator is provided by an elongated tubular bladder (24) running the length of the skirt panel, behind the panel just opposite the step. Inward deflection of the skirt panel indicative of an object trapped between the step and the panel increases the air pressure in the bladder. A switch (30) sensitive to the increased bladder pressure controls a relay (32) that shuts off the escalator drive motor (33) and applies the escalator brake (34).

1 Claim, 3 Drawing Figures

ESCALATOR SKIRT PANEL

TECHNICAL FIELD OF THE INVENTION

The invention relates to escalator safety devices.

BACKGROUND OF THE INVENTION

Trapping risks result from running clearances between adjacent parts of an escalator. One approach has been to reduce such clearances to a seemingly ultimate practicable level, as indicated by national standards (codes). In the area of the balustrade skirt panel to step clearance, use has been made of special materials and/or surface coatings to produce low-friction balustrade skirting. Nevertheless, it is still possible that an object may be trapped between the step and the skirt panel. This can cause an inward skirt panel deflection. A prior art approach to shutting down the escalator in the event of skirt panel deflection is to provide microswitches behind the skirt panel at discrete locations along its length, opposite the steps. The microswitches, when actuated, stop the escalator drive motor and cause the brake to be applied. This discrete approach does not provide for "complete" protection.

DISCLOSURE OF THE INVENTION

It is an object of this invention to provide full coverage protection for escalator shutdown in the event of trapping between the skirt panel and the step.

According to the invention, as elongated tubular bladder is disposed in contact with the inside of an escalator skirt panel, generally opposite the step. When the skirt panel is deflected inward, such as by an object trapped in the running clearance between the step and the skirt panel, air pressure increases in the bladder. A pressure-actuated electrical switch controls a relay in response to the increased bladder air pressure and, consequently, shuts down the escalator.

Other objects, features, and advantages of the invention will become apparent in light of the following description thereof.

BEST MODE FOR CARRYING OUT THE INVENTION

Figure 1:
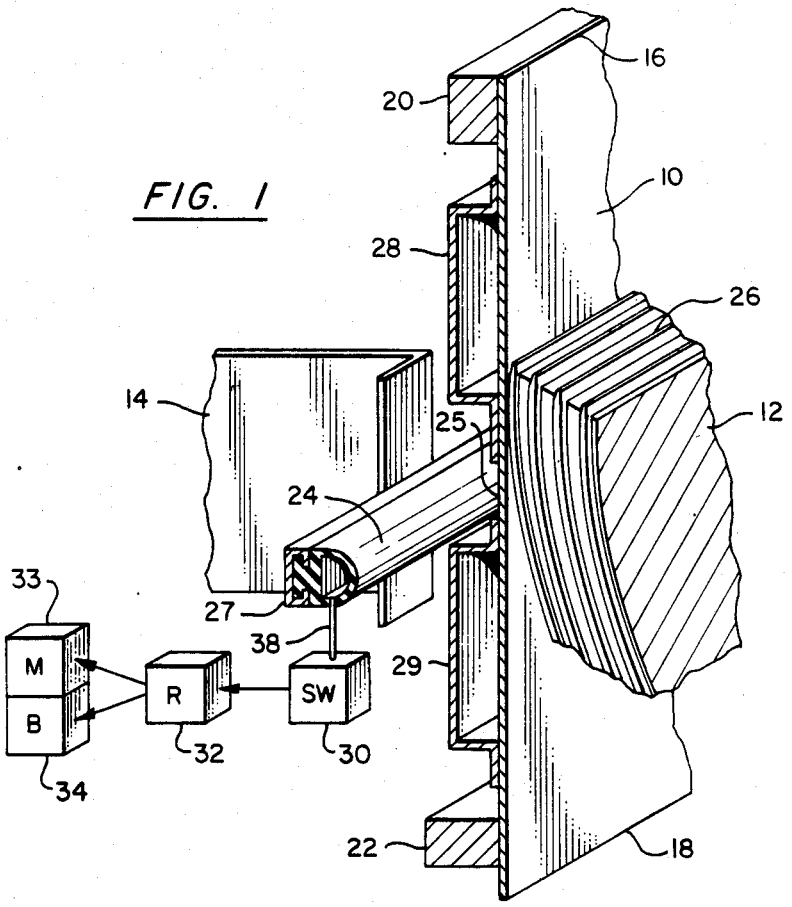
FIG. 1 is a perspective view, partly broken away and partly in cross section showing the invention.

FIG. 1 shows a balustrade skirt panel 10, an escalator step 12 disposed on the outside of the panel, and a truss member 14 disposed inside (behind) the panel for supporting various escalator components. The panel 10 is suitably attached at its upper edge 16 and near its bottom edge 18 to stationary escalator components 20 and 22 (shown figuratively), such as braces, decking profiles, etc.

An elongated, tubular bladder 24 is disposed behind the panel 10 and is in contact therewith in a bladder-abutting area 25, generally opposite the step tread 26, and extends longitudinally along the length of the skirt panel. The bladder is closed at both ends by suitable sealing means (not shown), and is mounted by means of a reinforcing rail 27 to the truss member 14. It will be readily apparent to one skilled in the art that the invention is equally applicable in the context of a stepless, continuous-belt travolator.

It will be noted that the skirt panel is reinforced by longitudinal members 28 and 29 located inside the panel above and below the bladder-abutting area 25. This makes the bladder-abutting area 25 the most flexible area of the skirt panel 10 so that an object trapped between the step and the skirt panel will readily deflect the panel inward. The inward deflection of the panel loads and pressurizes the bladder. A pressure actuated switch 30 in airflow communication with the bladder 24 activates a suitable shutoff relay 32, in response to the pressure, to shut off the escalator motor 33 and apply the escalator brake 34.

Figure 2:
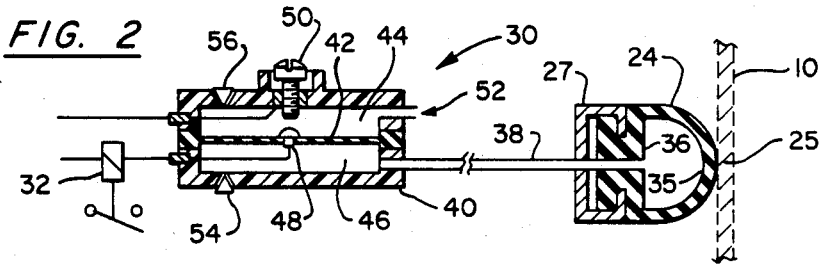
FIG. 2 is a cross-sectional view of the switching mechanism of the invention, not actuated.

FIG. 2 shows in detail the bladder 24 and the pressure switch 30. The bladder 24 is shown free of load, undeformed, abutting the skirt panel 10. The bladder has a generally semicircular cross section, with the apex 35 of the semicircle disposed abutting the panel 10 and the base 36 of the semicircle retained by the rail 27. The apex portion of the bladder is relatively thin-walled for easy deformation. The base portion of the bladder is thicker than the apex portion and is longitudinally notched along its upper and lower surfaces (as shown) to snap-fit securely into the "C" cross-section rail 27. A passageway, such as a PVC tube 38, provides airflow communication between the bladder 24 and the switch 30.

The switch 30 comprises a housing 40 divided into two chambers by a diaphragm 42; an atmospheric pressure chamber 44 and a bladder pressure chamber 46. The diaphragm 42 has an electrical contact 48 disposed at its center on its atmospheric pressure chamber side and suitably wired to outside the switch. The housing 40 has a corresponding screw-adjustable electrical contact 50 disposed on its atmospheric pressure chamber side, adjacent the contact 48, and suitably wired to outside the switch. When the bladder 24 is not loaded, in other words when the skirt panel is not deflected, the contacts 48 and 50 are normally open.

Figure 3:
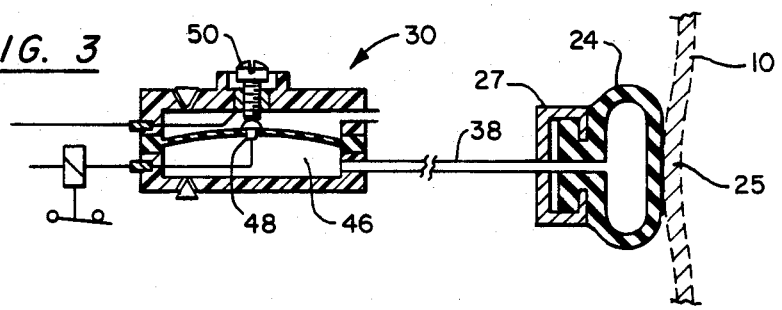
FIG. 3 is a cross-sectional view of the switching mechanism of the invention, actuated.

As shown in FIG. 3, when the skirt panel 10 is deformed, the bladder 24 is loaded (bulges) and pressurizes the chamber 46 of the switch. This causes the diaphragm 42 to deflect upward, and the electrical contacts 48,50 will complete a circuit to the relay 32.

The atmospheric chamber 44 is vented at 52. A relief valve 54 is provided in the chamber 46 to relieve destructive levels of overpressure therein. Similarly, a relief valve 56 in the chamber 44 prevents destructive pressure levels therein.

The bladder/switch as shown in FIGS. 2 and 3 is available from Bircher AG, Sparte Apparatebau, in Berringen-Schaffhausen Switzerland. It is typically used on the lower edge of automatic overhead doors to sense full closure of the door and/or implement door reversal upon contact with an object, such as an auto passing underneath the door. In the case of only 3 or 4 meter bladder lengths being available, and longer escalator lengths, the skirt panel deflection switches can be provided in series along each side of the escalator.

It should be understood that various changes may be made to the invention without departing from the spirit and scope thereof.

We claim:

1. A switch for an escalator that includes a skirt panel adjacent the moving steps thereof, each step having a tread surface, comprising:

an elongated tubular bladder contacting an area of the skirt panel generally opposite the tread surface along the entire length of the skirt panel;

means for providing a signal to shut down the escalator in response to increased pressure in the bladder indicative of inward skirt panel deflection; and stiffening members provided on the skirt panel above and below the bladder contact area so that the bladder contact area is a very resilient area on the skirt panel such that an object trapped between the moving steps and the skirt panel deflect said skirt panel in said bladder contact area.

* * * * *

UNITED STATES PATENT AND TRADEMARK OFFICE

CERTIFICATE OF CORRECTION

PATENT NO. : 4,669,597

DATED : June 2, 1987

INVENTOR(S) : Hans-Jurgen Langer, Peter Lehmann

It is certified that error appears in the above-identified patent and that said Letters Patent is hereby corrected as shown below:

In the title, "ESCALATOR SKIRT PANEL" should read --ESCALATOR SKIRT PANEL DEFLECTION SWITCH--.

Col. 1, line 30, "as" should read --an--.

Signed and Sealed this

Sixth Day of October, 1987

*Attest:*

DONALD J. QUIGG

*Attesting Officer*

*Commissioner of Patents and Trademarks*